US012448984B2

(12) United States Patent
Hsu et al.

(10) Patent No.: US 12,448,984 B2
(45) Date of Patent: Oct. 21, 2025

(54) CENTRIFUGAL FAN

(71) Applicant: DELTA ELECTRONICS, INC., Taoyuan (TW)

(72) Inventors: Kuo-Tung Hsu, Taoyuan (TW); Wen-Chun Hsu, Taoyuan (TW); Chao-Fu Yang, Taoyuan (TW); Shuo-Sheng Hsu, Taoyuan (TW); Cheng-Yuan Lee, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/743,029

(22) Filed: Jun. 13, 2024

(65) Prior Publication Data

US 2025/0215891 A1 Jul. 3, 2025

(30) Foreign Application Priority Data

Dec. 27, 2023 (CN) ..... 202323570276.7

(51) Int. Cl.
*F04D 29/42* (2006.01)
*F04D 29/44* (2006.01)
(Continued)

(52) U.S. Cl.
CPC ..... *F04D 29/4226* (2013.01); *F04D 29/4213* (2013.01); *F04D 29/424* (2013.01); *F04D 29/441* (2013.01); *F04D 17/16* (2013.01); *F04D 17/162* (2013.01); *F04D 29/281* (2013.01); *F04D 29/282* (2013.01); *F04D 29/4206* (2013.01); *F04D 29/444* (2013.01); *F04D 29/661* (2013.01); *F04D 29/663* (2013.01)

(58) Field of Classification Search
CPC ..... F04D 29/4226; F04D 29/4213; F04D 29/441; F04D 29/281; F04D 29/424; F04D 17/16; F04D 17/162; F04D 29/282; F04D 29/4206; F04D 29/661; F04D 29/663; F04D 29/444
See application file for complete search history.

(56) References Cited

U.S. PATENT DOCUMENTS 9,322,408 B2 * 4/2016 Tsai ..... F04D 29/4226
10,502,225 B2 12/2019 Knopp et al.
(Continued)

FOREIGN PATENT DOCUMENTS

CN 104110401 B 8/2016
TW M634195 U 11/2022

*Primary Examiner* — Nathaniel E Wiehe
*Assistant Examiner* — Art Golik
(74) *Attorney, Agent, or Firm* — CKC & Partners Co., LLC

(57) ABSTRACT

A centrifugal fan includes a housing and an impeller. A top side of the housing has a main air inlet. A bottom side of the housing has a holder, a board, and plural supporting ribs connecting the holder and the board. The holder, the board, and the supporting ribs define a first secondary air inlet and a second secondary air inlet. In the extending direction of the central axis of the impeller, the impeller projects an upper projection to the top side, and projects a lower projection to the bottom side. The size of the upper projection is greater than the size of the main air inlet. At least one portion of the outer edge of the first secondary air inlet, the outer edge of the lower projection and the central axis are arranged in sequence.

7 Claims, 7 Drawing Sheets

(51) Int. Cl.

| | |
|---|---|
| *F04D 17/16* | (2006.01) |
| *F04D 29/28* | (2006.01) |
| *F04D 29/66* | (2006.01) |

(56) References Cited

U.S. PATENT DOCUMENTS

| | | | | |
|---|---|---|---|---|
| 10,746,179 | B2 * | 8/2020 | Lu | F04D 25/0653 |
| 12,188,483 | B2 * | 1/2025 | Lin | F04D 29/281 |
| 2018/0142707 | A1 * | 5/2018 | Ting | F04D 29/023 |
| 2020/0370563 | A1 * | 11/2020 | Chen | F04D 29/181 |

* cited by examiner

CENTRIFUGAL FAN

CROSS-REFERENCE TO RELATED APPLICATION

This application claims priority to China Application Serial Number 202323570276.7, filed Dec. 27, 2023, which is herein incorporated by reference.

BACKGROUND

Field of Invention

The present disclosure relates to a fan. More particularly, the present disclosure relates to a centrifugal fan.

Description of Related Art

Electronic equipment usually generates heat during operation. If the heat is not efficiently removed, the electronic equipment may easily crash, or in severe cases, electronic components in the electronic equipment may be burned to result in property damage or causing the user to take damage. Generally speaking, designers may install a fan in the electronic equipment to solve the problem of excessive temperature. When the fan is in operation to generate wind, the heat generated by the electronic equipment can be removed through forced convection. In recent years, electronic chips generate higher temperatures due to their higher efficiency, so the speed of a motor in the fan has also been increasing. Although a higher motor speed can increase the air output of the fan, the fan with a higher speed also produces greater noise, thereby causing discomfort to the user.

In addition, the operation method of a centrifugal fan is that the air enters from the axial direction of an impeller and flows out from a lateral air outlet. Since the centrifugal fan can provide higher air pressure to a system, the centrifugal fan has been widely used. However, because a traditional centrifugal fan only has a single air inlet, when the size of the air inlet is smaller than the impeller by a certain extent, although the centrifugal fan can provide greater wind pressure, the noise also increases significantly. When the size of the air inlet is similar to that of the impeller, although air inlet volume is increased, operating air pressure is greatly reduced, which is not conducive to heat dissipation.

SUMMARY

One aspect of the present disclosure provides a centrifugal fan.

According to some embodiments of the present disclosure, a centrifugal fan includes a housing and an impeller. A top side of the housing has a main air inlet. A bottom side of the housing has a holder, a board, and plural supporting ribs connecting the holder and the board. The holder, the board, and the supporting ribs define a first secondary air inlet and a second secondary air inlet. The impeller has a central axis and a hub portion, and is installed on the holder, wherein the top surface and the bottom surface of the hub portion respectively face toward the top side and the bottom side. In the extending direction of the central axis, the impeller projects an upper projection to the top side, and projects a lower projection to the bottom side. The size of the upper projection is greater than the size of the main air inlet, and at least one portion of the outer edge of the first secondary air inlet, the outer edge of the lower projection and the central axis are arranged in sequence.

In some embodiments, the first secondary air inlet does not shield an outer edge of the impeller.

In some embodiments, the second secondary air inlet shields a portion of the outer edge of the impeller.

In some embodiments, a ratio of an area of the first secondary air inlet not shielding the impeller to an area of the second secondary air inlet not shielding the impeller is in a range from 1.4 to 1.6.

In some embodiments, lengths of edges of the supporting ribs are not exactly the same.

In some embodiments, angles formed between connection lines of every two adjacent supporting ribs in a radial direction of the impeller and a center of the holder are not exactly the same or are in an asymmetrical arrangement.

In some embodiments, the impeller has a plurality of blades, and maximum distances between the adjacent blades are not exactly the same.

In some embodiments, a sidewall portion of the housing has a lateral air outlet, and a sum of areas of the first secondary air inlet and the second secondary air inlet is greater than an area of the lateral air outlet.

In some embodiments, an outline shape of the first secondary air inlet or the second secondary air inlet is an irregular shape.

In some embodiments, the outer edge of the first secondary air inlet or an outer edge of the second secondary air inlet extends to a sidewall portion of the housing.

Another aspect of the present disclosure provides a centrifugal fan.

According to some embodiments of the present disclosure, a centrifugal fan includes a housing and an impeller. A top side of the housing has a main air inlet. A bottom side of the housing has a holder, a board, and a plurality of supporting ribs connecting the board and the holder. A sidewall portion of the housing has a lateral air outlet. The holder, the board, and the supporting ribs define a first secondary air inlet, and an outline shape of the first secondary air inlet is an irregular shape. The impeller has a central axis and a hub portion, and is installed on the holder. A top surface and a bottom surface of the hub portion respectively face toward the top side and the bottom side. In an extending direction of the central axis, the impeller projects an upper projection to the top side, and projects a lower projection to the bottom side. A size of the upper projection is greater than a size of the main air inlet. At least one portion of an outer edge of the first secondary air inlet, an outer edge of the lower projection and the central axis are arranged in sequence.

In some embodiments, the first secondary air inlet does not shield an outer edge of the impeller.

In some embodiments, the housing further includes a second secondary air inlet shielding a portion of an outer edge of the impeller.

In some embodiments, a ratio of an area of the first secondary air inlet not shielding the impeller to an area of the second secondary air inlet not shielding the impeller is in a range from 1.4 to 1.6.

In some embodiments, a sum of areas of the first secondary air inlet and the second secondary air inlet is greater than an area of the lateral air outlet.

In some embodiments, an outline shape of the second secondary air inlet is an irregular shape.

In some embodiments, an outer edge of the second secondary air inlet extends to the sidewall portion of the housing.

In some embodiments, lengths of edges of the supporting ribs are not exactly the same.

In some embodiments, angles formed between connection lines of every two adjacent supporting ribs in a radial direction of the impeller and a center of the holder are not exactly the same or are in an asymmetrical arrangement.

In some embodiments, the impeller has a plurality of blades, and maximum distances between the adjacent blades are not exactly the same.

In the aforementioned embodiments of the present disclosure, since the top side and the bottom side of the housing respectively have the main air inlet and the first secondary air inlet defined by the holder, the board, and the supporting ribs, the centrifugal fan has the ability to receive air from two opposite sides. Moreover, the size of the upper projection projected to the top side by the impeller of the centrifugal fan is greater than the size of the main air inlet, and at least one portion of the outer edge of the first secondary air inlet, the outer edge of the lower projection and the central axis are arranged in sequence, and thus such a design can reduce a noise difference between the main air inlet and the first secondary air inlet of the centrifugal fan under the same air output volume to achieve a balance between air volume and noise. In addition, when the centrifugal fan is disposed on a fixed surface by a user, the user does not need to consider whether the top side or the bottom side of the housing faces the fixed surface, which facilitates installation and improves product competitiveness.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
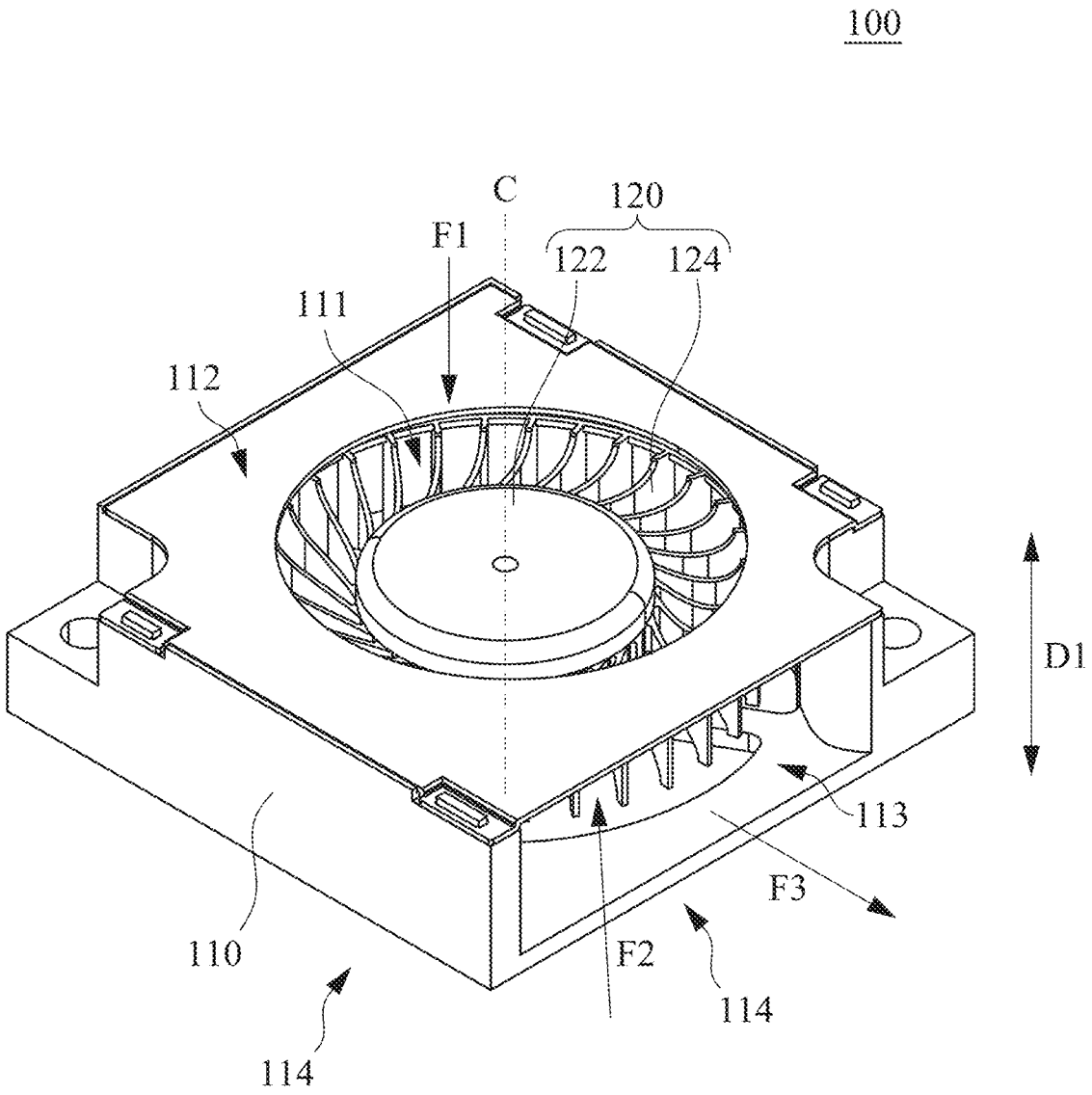
FIG. 1 is a perspective view of a centrifugal fan according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
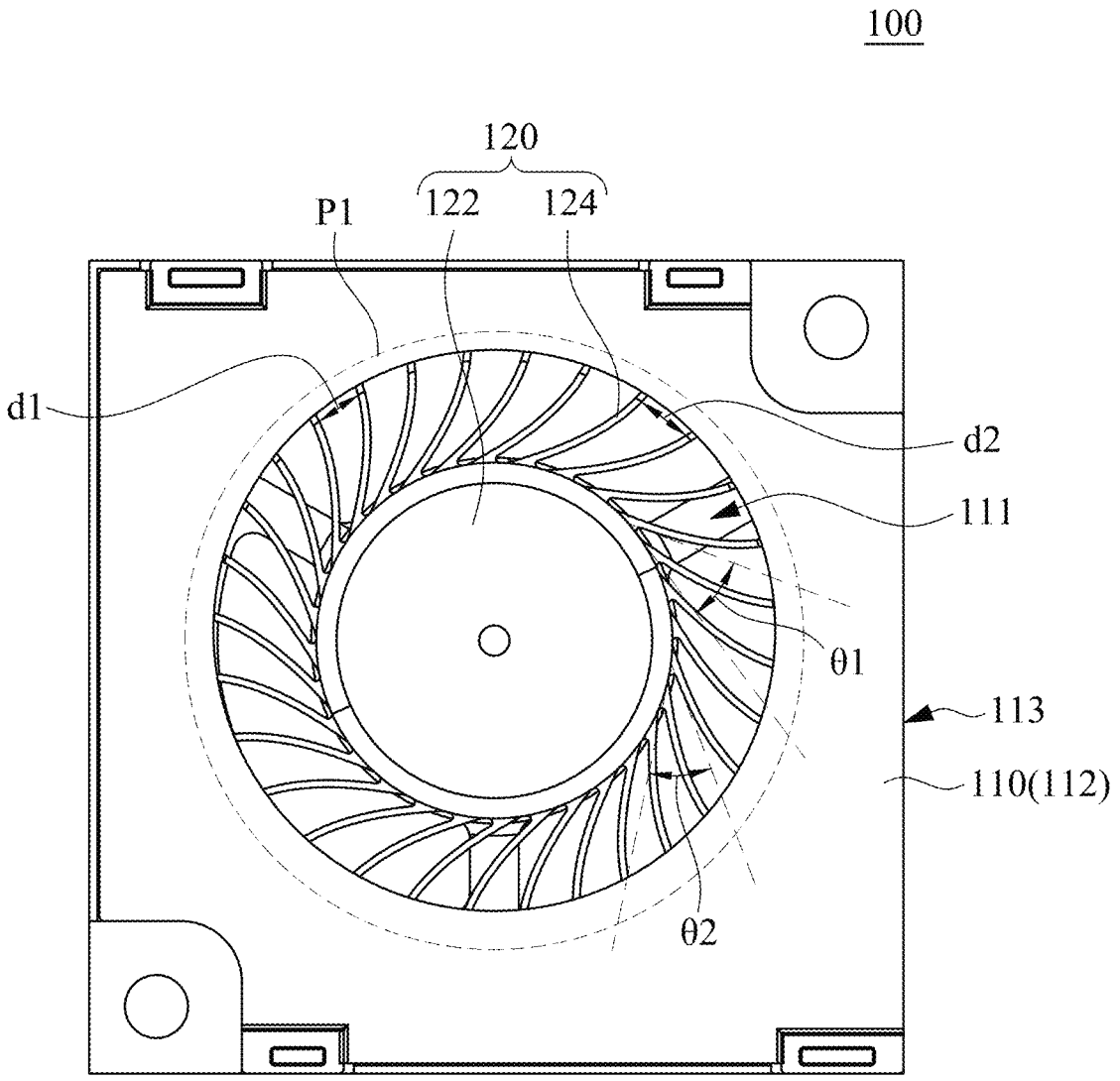
FIG. 2 is a top view of the centrifugal fan of FIG. 1.

FIG. 1 is a perspective view of a centrifugal fan 100 according to one embodiment of the present disclosure. FIG. 2 is a top view of the centrifugal fan 100 of FIG. 1. As shown in FIG. 1 and FIG. 2, the centrifugal fan 100 includes a housing 110 and an impeller 120. A top side 112 of the housing 110 may be a metal plate, and a bottom side 114 of the housing 110 may be a plastic base, but the present disclosure is not limited in this regard. The top side 112 of the housing 110 has a main air inlet 111. The sidewall portion of the housing 110 has a lateral air outlet 113. The impeller 120 has a central axis C and a hub portion 122. The top surface and the bottom surface of the hub portion 122 respectively face toward the top side 112 and the bottom side 114 of the housing 110. In an extending direction D1 of the central axis C of the impeller 120, the impeller 120 projects an upper projection P1 to the top side 112 of the housing 110. In order to clarify the drawings, the upper projection P1 merely shows the vertical projected profile of the outer edge of the impeller 120 on the top side 112 of the housing 110, and is illustrated by a dashed line. The size of the upper projection P1 of the impeller 120 is greater than the size of the main air inlet 111. In other words, in the extending direction D1 of the impeller 120, the main air inlet 111 does not expose the outer edge of the impeller 120. The area surrounded by the outer edge of the impeller 120 is greater than the area of the main air inlet 111. Furthermore, in this embodiment, the impeller 120 has a plurality of blades 124, and maximum distances between the adjacent blades 124 are not exactly the same. As shown in FIG. 2, an angle θ1 formed between one of the blades 124 and the hub portion 122 is less than an angle θ2 that is formed between another one of the blades 124 and the hub portion 122.

Figure 3:
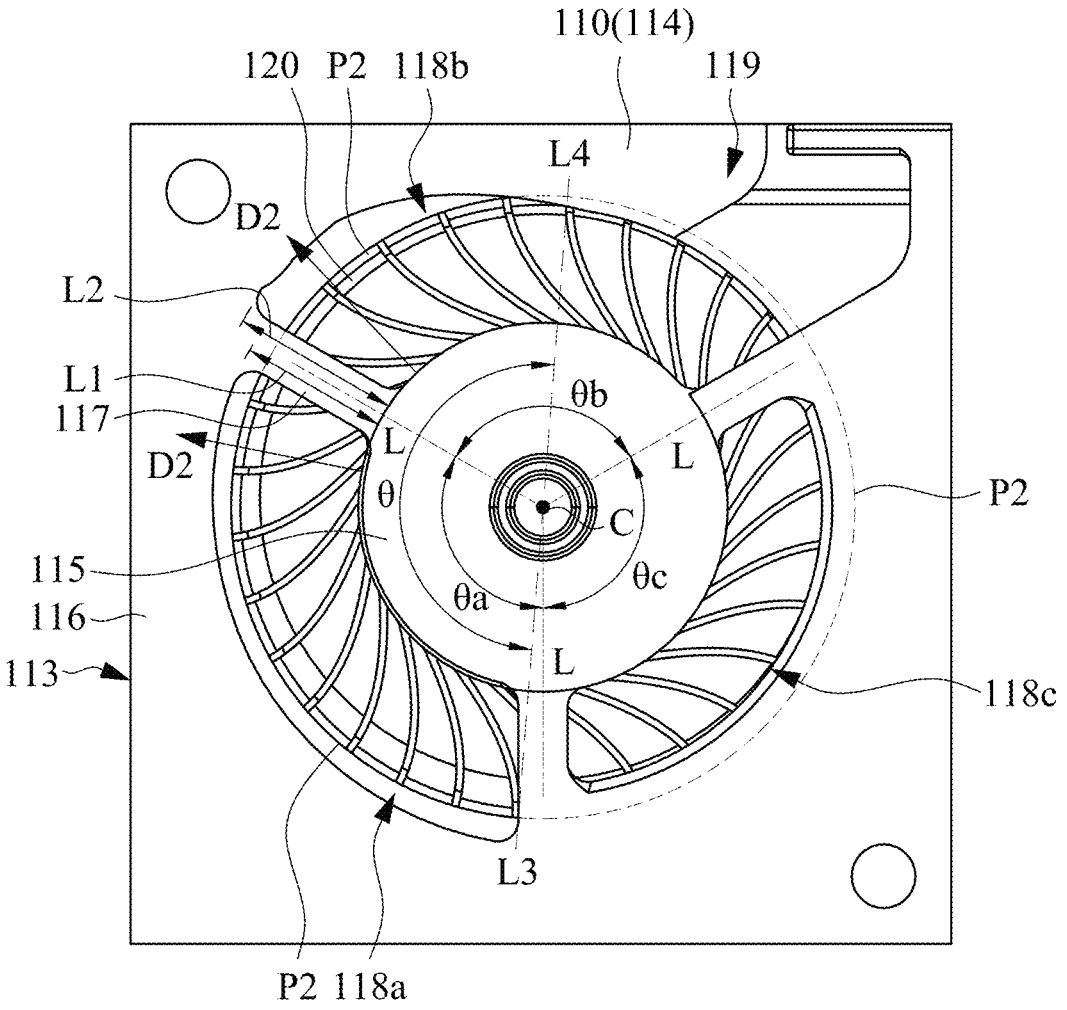
FIG. 3 and FIG. 4 are bottom views of the centrifugal fan of FIG. 1.
Figure 4:
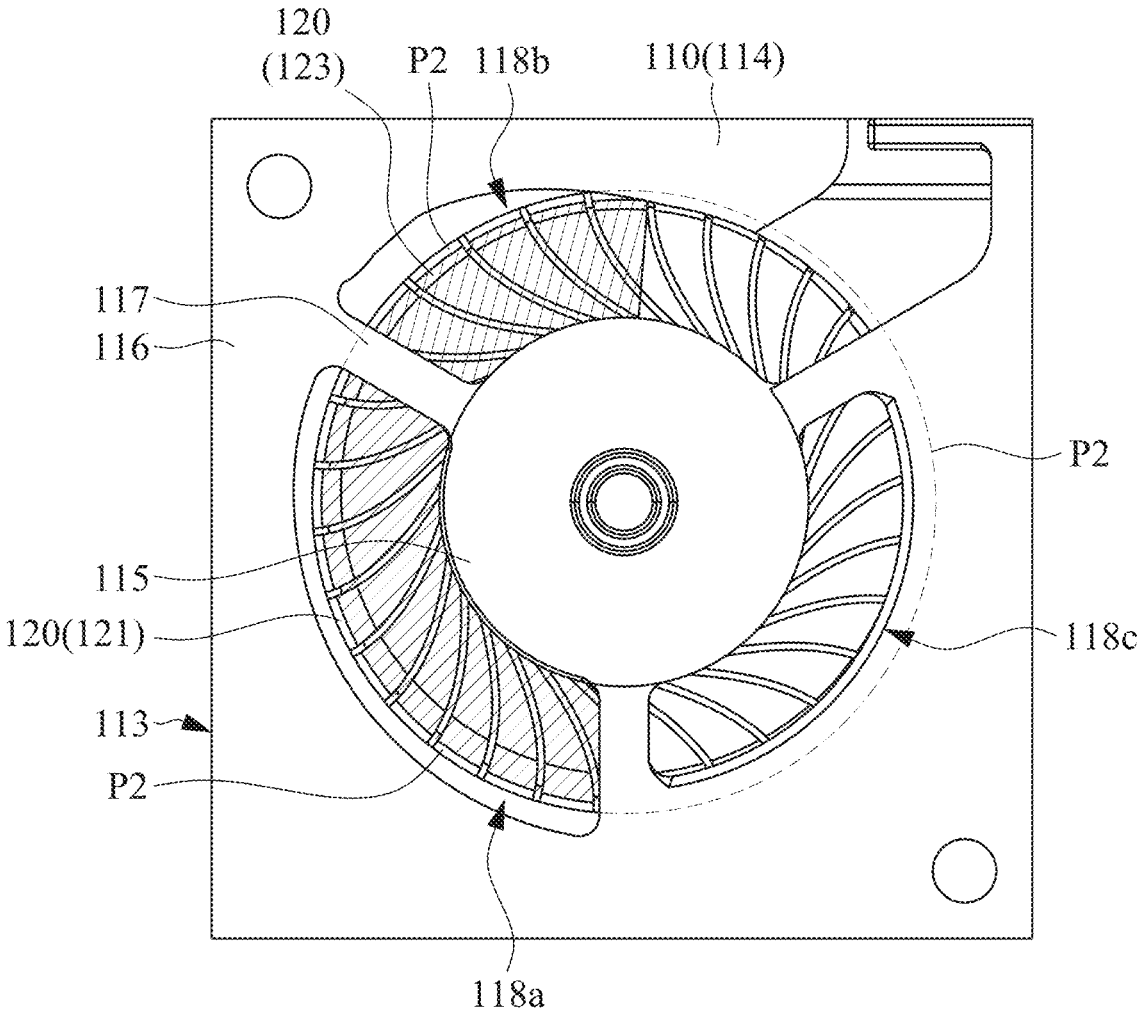

FIG. 3 and FIG. 4 are bottom views of the centrifugal fan 100 of FIG. 1. As shown in FIG. 1 and FIG. 3, the bottom side 114 of the housing 110 has a holder 115, a board 116, and plural supporting ribs 117. Two ends of the supporting rib 117 respectively connect the board 116 and the holder 115. The holder 115, the board 116, and the supporting ribs 117 of the bottom side 114 of the housing 110 define a first secondary air inlet 118*a* and a second secondary air inlet 118*b*. In this embodiment, the bottom side 114 of the housing 110 further has a third secondary air inlet 118*c*, but the number of the secondary air inlets is not limited in this regard. The impeller 120 is installed on the holder 115 of the bottom side 114.

When the centrifugal fan 100 is in operation, an air flow F1 and an air flow F2 can respectively enter from the main air inlet 111 of the top side 112 and the first, second, and third secondary air inlets 118*a*, 118*b*, and 118*c*, and an air flow F3 is formed to blow out from the lateral air outlet 113. In some embodiments, the main air inlet 111 can be closed and only the air flow F2 is sucked by the first, second, and third secondary air inlets 118*a*, 118*b*, and 118*c*. Alternatively, the first, second, and third secondary air inlets 118*a*, 118*b*, and 118*c* can be closed and only the air flow F1 is sucked by the main air inlet 111.

Moreover, in the extending direction D1 of the central axis C of the impeller 120, the impeller 120 projects a lower projection P2 to the bottom side 114. In order to clarify the drawings, the lower projection P2 merely shows the vertical projected profile of the outer edge of the impeller 120 on the bottom side 114 of the housing 110, and the lower projection P2 on the housing 110 is illustrated by a dashed line. The lower projection P2 in the first and second secondary air inlets 118*a* and 118*b* overlaps the outer edge of the impeller 120, and thus a dashed line is omitted and the outer edge of the impeller 120 is used to represent. At least one portion of the outer edge of the first secondary air inlet 118*a*, the outer edge of the lower projection P2, and the central axis C are arranged in sequence.

In this embodiment, the first secondary air inlet 118*a* does not shield an outer edge of the impeller 120, and the second secondary air inlet 118*b* shields a portion of the outer edge of the impeller 120. In other words, the first and second secondary air inlet 118*a* and 118*b* may extend to outside the edge of the lower projection P2 in radial directions D2 of the impeller 120. It should be understood that the radial directions D2 of the impeller 120 shown in FIG. 3 are merely examples, and the radial directions of the impeller 120 may be referred to as plural directions radiating outward from the center of the impeller 120.

Specifically, since the top side 112 and the bottom side 114 of the housing 110 respectively have the main air inlet 111 and the first, second, and third secondary air inlets 118*a*, 118*b*, and 118*c* defined by the holder 115, the board 116, and the supporting ribs 117, the centrifugal fan 100 has the ability to receive air from two opposite sides. Moreover, the size of the upper projection P1 (see FIG. 2) projected to the top side 112 by the impeller 120 of the centrifugal fan 100 is greater than the size of the main air inlet 111, and at least one portion of the outer edge of the first secondary air inlet 118*a*, the outer edge of the lower projection P2 and the central axis C are arranged in sequence, and thus such a design can reduce a noise difference between the main air inlet 111 and the first secondary air inlet 118*a* of the centrifugal fan 100 under the same air output volume to achieve a balance between air volume and noise. In addition, when the centrifugal fan 100 is disposed on a fixed surface by a user (will be described in FIG. 5 to FIG. 7), the user does not need to consider whether the top side 112 or the bottom side 114 of the housing 110 faces the fixed surface, which facilitates installation and improves product competitiveness.

As shown in FIG. 1 and FIG. 3, the ratio of the area of the main air inlet 111 of the top side 112 of the housing 110 to the sum of the areas of the first, second, and third secondary air inlets 118*a*, 118*b*, and 118*c* of the bottom side 114 of the housing 110 is in a range from 1.3 to 1.5. For example, the area of the main air inlet 111 may be 598 $mm^2$, the sum of the areas of the first, second, and third secondary air inlets 118*a*, 118*b*, and 118*c* may be 421 $mm^2$, and the ratio is 1.42. In this embodiment, the sum of areas of the first secondary air inlet 118*a* and the second secondary air inlet 118*b* is greater than the area of the lateral air outlet 113. For example, the area of the lateral air outlet 113 is 273 $mm^2$. In this embodiment, the outline shape of the second secondary air inlet 118*b* is an irregular shape, and the outer edge of the second secondary air inlet 118*b* extends to the sidewall portion of the housing 110. In another embodiment, the outline shape of the first secondary air inlet 118*a* may be replaced with the irregular shape of the second secondary air inlet 118*b* and extend to the sidewall portion of the housing 110, and the outline shape of the second secondary air inlet 118*b* may be replaced with the outline shape of the first secondary air inlet 118*a*.

In this embodiment, the lengths of the edges of the supporting ribs 117 of the bottom side 114 of the housing 110 are not exactly the same. For example, a length L1 of an edge of the supporting rib 117 is less than a length L2 of another opposite edge of the supporting rib 117. In addition, the lengths of the edges of different supporting ribs 117 may have different lengths. For example, the length of the edge of the supporting rib 117 adjacent to the third secondary air inlet 118*c* is less than the length L1 and the length L2. Furthermore, angles θa, θb and θc formed between connection lines of every two adjacent supporting ribs 117 in the radial direction of the impeller 120 and the center of the holder 115 are not exactly the same or are in an asymmetrical arrangement. For example, the angle θ*a* is equal to the angle θb but greater than the angle θc. Alternatively, the angle θa is greater than the angle θb, and the angle θb is greater than the angle θc. In addition, an angle θ formed between two connection lines L3 and L4 that are respectively between one end of the outer edge of the impeller 120 exposed through the first secondary air inlet 118*a* and the center of the holder 115 and between another end of outer edge of the impeller 120 exposed through the second secondary air inlet 118*b* and the center of the holder 115 is greater than 90 degrees.

As shown in FIG. 4, in this embodiment, a first portion 121 of the impeller 120 is located in the first secondary air inlet 118*a*, and the first secondary air inlet 118*a* completely exposes the outer edge of the first portion 121 of the impeller 120. A second portion 123 of the impeller 120 is located in the second secondary air inlet 118*b*, and the second secondary air inlet 118*b* partially exposes the outer edge of the second portion 123 of the impeller 120. Moreover, the ratio of the area of the first secondary air inlet 118*a* not shielding the impeller 120 to the area of the second secondary air inlet 118*b* not shielding the impeller 120 is in a range from 1.4 to 1.6, as illustrated in two slash areas of the impeller 120 respectively in the first and second secondary air inlets 118*a* and 118*b* of FIG. 4. For example, the slash area of the first portion 121 of the impeller 120 in the first secondary air inlet 118*a* may be 29.6 $mm^2$, the slash area of the second portion 123 of the impeller 120 in the second secondary air inlet 118*b* may be 19.4 $mm^2$, and the ratio is 1.52.

As shown in FIG. 1 and FIG. 4, in on embodiment, table 1 below shows the size design of the impeller 120, the main air inlet 111, the first, second and third secondary air inlets 118*a*, 118*b* and 118*c*, and the lateral air outlet 113. The area of the secondary air inlet in table 1 is referred to as the sum of areas of the first, second and third secondary air inlets 118*a*, 118*b* and 118*c* without the areas of the holder 115 and the supporting ribs 117. The equivalent diameter is referred to as the diameter of each of the circles respectively can be formed by the area of the impeller 120, the area of the main air inlet 111, the sum of the areas of the first, second and third secondary air inlets 118*a*, 118*b* and 118*c*, and the area of the lateral air outlet 113. Table 1 shows the equivalent diameter of the impeller 120 is greater than the equivalent diameter of the main air inlet 111, the equivalent diameter of the main air inlet 111 is greater than the equivalent diameter of the first, second and third secondary air inlets 118*a*, 118*b* and 118*c*, and the equivalent diameter of the first, second and third secondary air inlets 118*a*, 118*b* and 118*c* is greater than the equivalent diameter of the lateral air outlet 113. In addition, the area of the main air inlet 111 may be 0.8 times to 0.85 times (e.g., 0.82 times) the area of the impeller 120, the sum of the areas of the first, second and third secondary air inlets 118*a*, 118*b* and 118*c* may be 0.55 times to 0.6 times (e.g., 0.58 times) the area of the impeller 120, and the area of the lateral air outlet 113 may be 0.35 times to 0.4 times (e.g., 0.37 times) the area of the impeller 120.

TABLE 1

| | Impeller | Main air inlet | Secondary air inlet | Lateral air outlet |
|---|---|---|---|---|
| Area($mm^2$) | 725 | 598 | 421 | 273 |
| Equivalent diameter(mm) | 30.4 | 27.6 | 23.2 | 18.6 |
| Area ratio | 1 | 0.82 | 0.58 | 0.37 |

It is to be noted that the connection relationships, the materials, and the advantages of the elements described above will not be repeated in the following description. In the following description, the configuration and the measurement data of the above centrifugal fan 100 when being in use will be explained.

Figure 5:
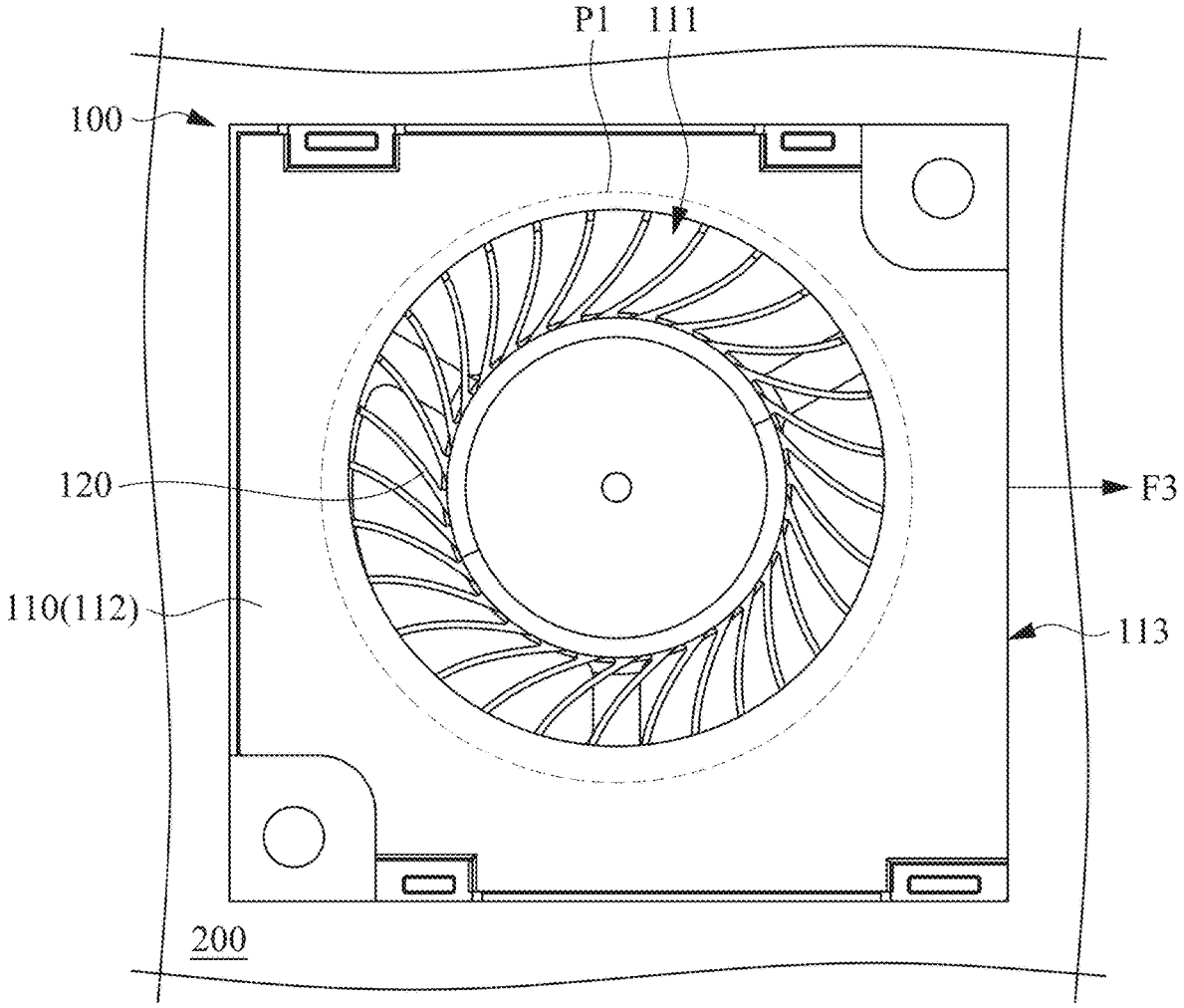
FIG. 5 is a schematic view of the centrifugal fan of FIG. 1 when the bottom side of the housing of the centrifugal fan is disposed on a fixed surface.

FIG. 5 is a schematic view of the centrifugal fan 100 of FIG. 1 when the bottom side 114 of the housing 110 of the centrifugal fan 100 is disposed on a fixed surface 200, which may be a top view, a bottom view, or a front view. The fixed surface 200 may be the surface of a board body, such as the surface of an upper board, the surface of a lower board, or the surface of a lateral board, depending on installation requirements. In this embodiment, the fixed surface 200 covers the first, second and third secondary air inlets 118*a*, 118*b* and 118*c* (see FIG. 4) of the bottom side 114 (see FIG. 4) of the housing 110. When the impeller 120 of FIG. 5 rotates, a wind enters the main air inlet 111, and the lateral air outlet 113 generates the air flow F3.

Figure 6:
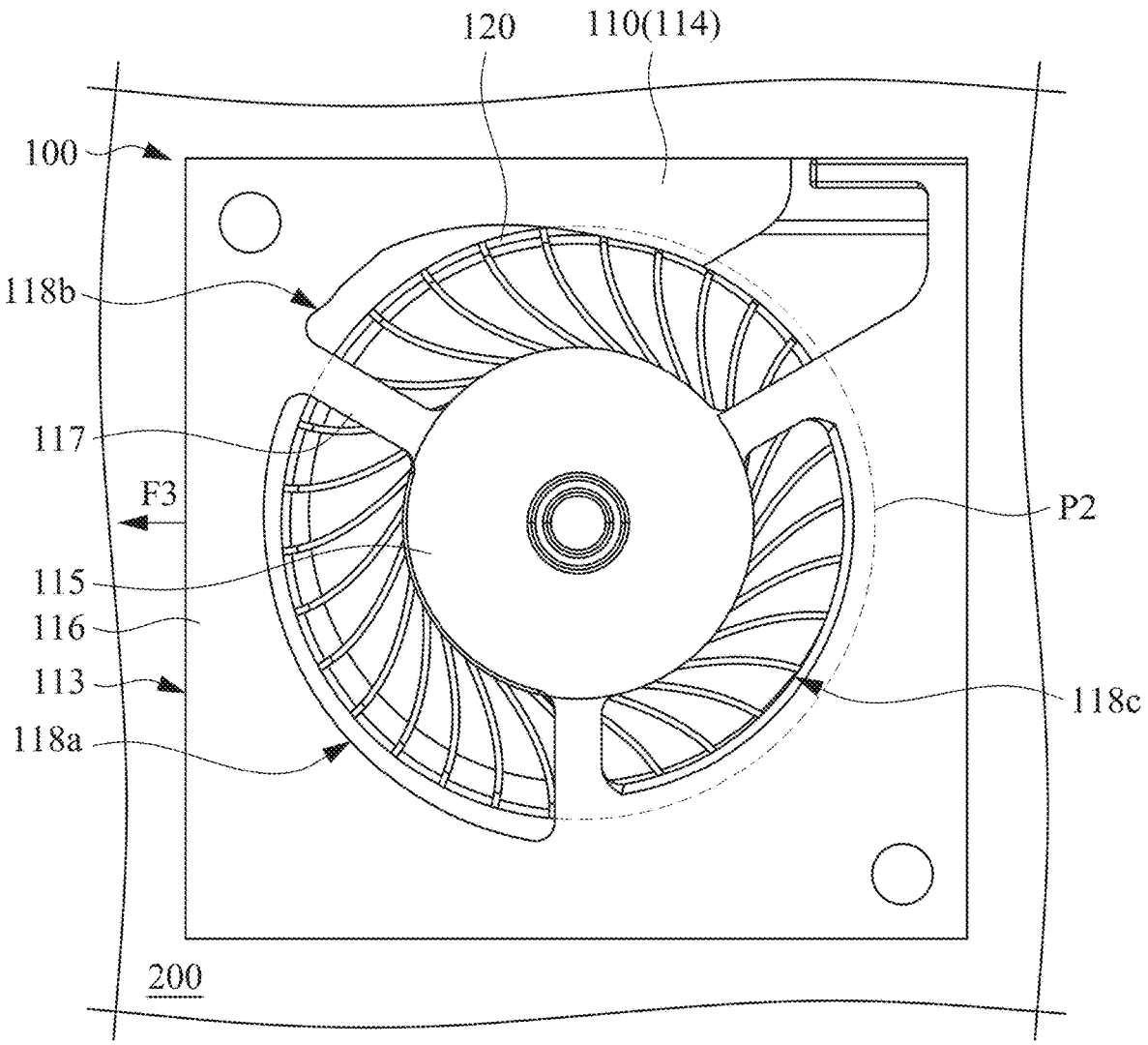
FIG. 6 is a schematic view of the centrifugal fan of FIG. 1 when the top side of the housing of the centrifugal fan is disposed on a fixed surface.

FIG. 6 is a schematic view of the centrifugal fan 100 of FIG. 1 when the top side 112 of the housing 110 of the centrifugal fan 100 is disposed on the fixed surface 200, which may be a top view, a bottom view, or a front view. The fixed surface 200 may be the surface of a board body, such as the surface of an upper board, the surface of a lower board, or the surface of a lateral board, depending on installation requirements. In this embodiment, the fixed surface 200 covers the main air inlet 111 of the top side 112 (see FIG. 2) of the housing 110. When the impeller 120 of FIG. 6 rotates, a wind enters the first, second and third secondary air inlets 118*a*, 118*b* and 118*c*, and the lateral air outlet 113 generates the air flow F3.

Figure 7:
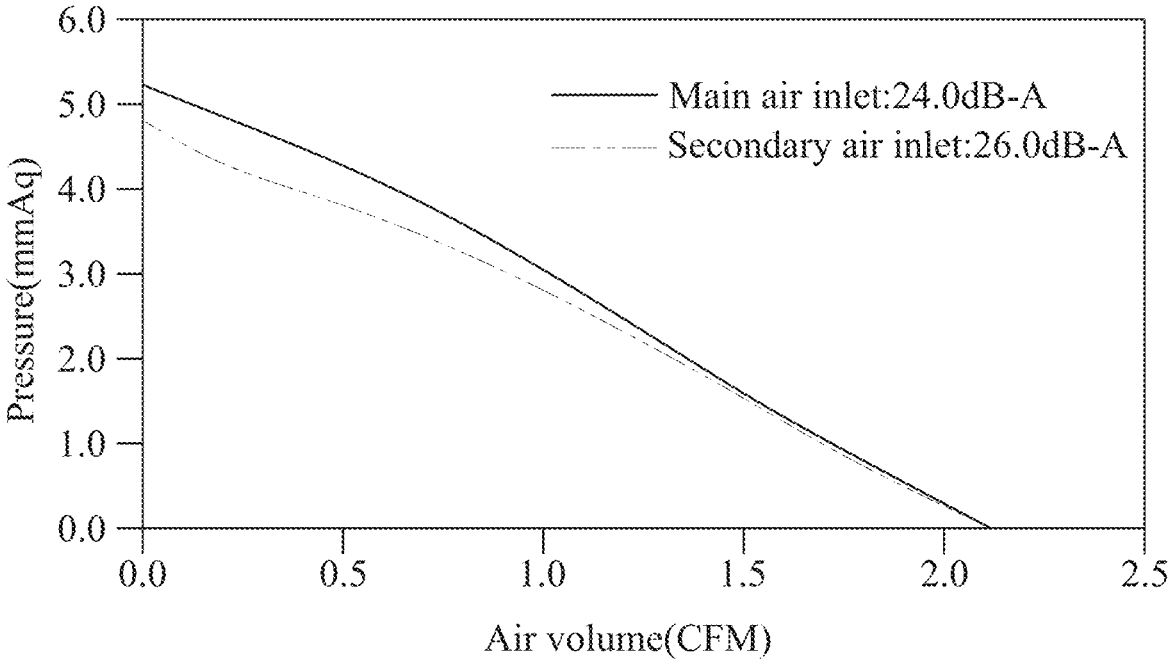
FIG. 7 is a pressure-air volume relationship diagram of the centrifugal fan of FIG. 5 and FIG. 6 when the centrifugal fan is in use.

FIG. 7 is a pressure-air volume relationship diagram of the centrifugal fan 100 of FIG. 5 and FIG. 6 when the centrifugal fan 100 is in use. When the aforementioned centrifugal fan 100 is applied with single-side air inlets in FIGS. 5 and 6, the noise difference with the same air volume is less than 3 dB-A. For example, when the air flow F3 of the lateral air outlet 113 is 2.12 CFM, the noise in the configuration where the air is taken in from the main air inlet 111 of FIG. 5 is 24.0 dB-A, while the noise in the configuration where the air is taken in from the first, second and third secondary air inlets 118*a*, 118*b* and 118*c* of FIG. 6 is 26.0 dB-A. Therefore, the noise difference with the same air volume is merely 2 dB-A. The centrifugal fan 100 can achieve a balance between air volume and noise. In addition, when the centrifugal fan 100 is disposed on the fixed surface 200 by a user, the user does not need to consider whether the top side 112 or the bottom side 114 of the housing 110 faces the fixed surface 200, which facilitates installation and improves product competitiveness.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A centrifugal fan, comprising:

a housing, wherein a top side of the housing has a main air inlet, a bottom side of the housing has a holder, a board, and a plurality of supporting ribs connecting the board and the holder, and the holder, the board, and the supporting ribs define a first secondary air inlet and a second secondary air inlet; and an impeller having a central axis and a hub portion, and installed on the holder, wherein a top surface and a bottom surface of the hub portion respectively face toward the top side and the bottom side, the first secondary air inlet does not shield an outer edge of the impeller, the second secondary air inlet shields a portion of the outer edge of the impeller, and a ratio of an area of the first secondary air inlet not shielding the impeller to an area of the second secondary air inlet not shielding the impeller is in a range from 1.4 to 1.6;

wherein in an extending direction of the central axis, the impeller projects an upper projection to the top side, and projects a lower projection to the bottom side;

wherein a size of the upper projection is greater than a size of the main air inlet, and at least one portion of an outer edge of the first secondary air inlet, an outer edge of the lower projection, and the central axis are arranged in sequence.

2. The centrifugal fan of claim 1, wherein lengths of edges of the supporting ribs are not exactly the same.

3. The centrifugal fan of claim 1, wherein connection lines extending from a center of the holder to the supporting ribs are formed in radial directions of the impeller, and angles formed between every two adjacent of the connection lines are not exactly the same or are in an asymmetrical arrangement.

4. The centrifugal fan of claim 1, wherein the impeller has a plurality of blades, and a maximum distance that is between two adjacent blades of the plurality of blades and a maximum distance that is between another two adjacent blades of the plurality of blades are not exactly the same.

5. The centrifugal fan of claim 1, wherein a sidewall portion of the housing has a lateral air outlet, and a sum of areas of the first secondary air inlet and the second secondary air inlet is greater than an area of the lateral air outlet.

6. The centrifugal fan of claim 1, wherein an outline shape of the first secondary air inlet or the second secondary air inlet is an irregular shape.

7. The centrifugal fan of claim 1, wherein an outer edge of the second secondary air inlet extends to a sidewall portion of the housing.

* * * * *